US006247941B1

(12) United States Patent
Lee et al.

(10) Patent No.: US 6,247,941 B1
(45) Date of Patent: Jun. 19, 2001

(54) COMBINATION ELECTRIC CONNECTOR HAVING MULTIPLE GROUNDING PRONG RECEIVING PORTIONS AND A PLUG UNIT SECURED BY MEANS OF A PLURALITY OF HOOKS AND COUPLING FLANGES

(76) Inventors: Chiu-Shan Lee; Shen Su-Chen Li, both of No. 31 Lane 18, Chang-Chun Rd., Hsintien City, Taipei County (TW)

( * ) Notice: Subject to any disclaimer, the term of this patent is extended or adjusted under 35 U.S.C. 154(b) by 0 days.

(21) Appl. No.: 09/542,914

(22) Filed: Apr. 4, 2000

(51) Int. Cl.[7] ..... H01R 13/648

(52) U.S. Cl. ..... 439/105; 439/172; 439/149; 439/103

(58) Field of Search ..... 439/105, 106, 439/171, 172, 518, 149, 135, 103

(56) References Cited

U.S. PATENT DOCUMENTS 4,201,431 * 5/1980 McDonald ..... 439/103
5,135,404 * 8/1992 Clark et al. ..... 439/106
5,213,516 * 5/1993 Okamoto ..... 439/104
5,282,753 * 2/1994 Su ..... 439/106
5,848,907 * 12/1998 Chen ..... 439/172
5,919,060 * 7/1999 Lee ..... 439/518
5,938,459 * 8/1999 Lee et al. ..... 439/172
6,053,750 * 4/2000 Waible ..... 439/106

* cited by examiner

*Primary Examiner*—Brian Sircus
*Assistant Examiner*—Son V. Nguyen
(74) *Attorney, Agent, or Firm*—Rosenberg, Klein & Lee

(57) ABSTRACT

A combination electric connector includes a socket unit and a plug unit, the socket unit having a set of plug blade receiving holes extended through a front side thereof for receiving the metal blades of an electric plug, two grounding prong receiving portions disposed at two opposite lateral sides thereof for receiving the grounding prong or grounding wire of an electric plug, a substantially U-shaped grounding metal plate installed in the grounding prong receiving portions and extended over a rear side thereof, two metal contact plates respectively mounted in the plug blade receiving holes and extended out of the rear side, the plug unit having a plurality of hooks and coupling flanges respectively fastened to the rear side of the socket unit, and a set of metal rod members respectively disposed in contact with the metal contact plates for connection to an electric socket.

7 Claims, 12 Drawing Sheets

COMBINATION ELECTRIC CONNECTOR HAVING MULTIPLE GROUNDING PRONG RECEIVING PORTIONS AND A PLUG UNIT SECURED BY MEANS OF A PLURALITY OF HOOKS AND COUPLING FLANGES

BACKGROUND OF THE INVENTION

The present invention relates to a combination electric connector, and more particularly to such a combination electric connector, which comprises a socket unit for receiving any of a variety of electric plugs, and a plug unit fastened to the socket unit for connection to any of a variety of electric socket.

Regular electric plugs and electric sockets commonly include a two-wire system and a three-wire system. A two-wire system electric plug or electric socket does not have a grounding terminal. A three-wire system electric plug cannot be installed in a two-wire system electric socket. When installing a three-wire system electric plug in a two-wire system electric socket, an adapter shall be used. FIG. 16 shows an electric plug adapter 92 used with a three-wire electric plug 9. The three-wire electric plug 9 comprises two metal blades and a grounding prong. The electric plug adapter 92 comprises three receiving holes at the backside for receiving the metal blades and grounding prong of the three-wire electric plug 9, and two metal blades at the front side for connection to an electric socket. Because the electric plug adapter 92 is made subject to a particularly design of three-wire system electric plug, it cannot fit different electric plugs.

SUMMARY OF THE INVENTION

It is one object of the present invention to provide a combination electric connector, which fits any of a variety of two-wire system as well as three-wire system electric sockets, and any of a variety of two-wire system as well as three-wire system electric plugs. According to one embodiment of the present invention, the combination electric connector comprises a socket unit and a plug unit. The socket unit comprises a set of plug blade receiving holes extended through a front side thereof for receiving the metal blades of an electric plug, two grounding prong receiving portions disposed at two opposite lateral sides thereof for receiving the grounding prong or grounding wire of an electric plug, a substantially U-shaped grounding metal plate installed in the grounding prong receiving portions and extended over a rear side thereof, and two metal contact plates respectively mounted in the plug blade receiving holes and extended out of the rear side. The plug unit comprises a plurality of hooks and coupling flanges respectively fastened to the rear side of the socket unit, and a set of metal rod members respectively disposed in contact with the metal contact plates for connection to an electric socket. According to an alternate form of the present invention, the plug unit comprises a transverse plughole, and a detachable grounding prong assembly. The detachable grounding prong assembly comprises a base having a plug portion press-fitted into the transverse plug hole on the plug unit, and a grounding prong having a rear contact end disposed in contact with the grounding metal plate of the socket unit.

BRIEF DESCRIPTION OF THE DRAWINGS

FIG. 4-1 shows the combination electric connector equipped a two-wire plug unit and used with a two-wire electric plug according to the present invention.

FIG. 4-2 shows the combination electric connector equipped with a three-wire plug unit and used with a two-wire electric plug according to the present invention.

FIG. 4-3 shows the combination electric connector equipped with a two- wire electric plug unit and used with a three-wire electric plug according to the present invention.

FIG. 4-4 shows the combination electric connector equipped with a three-wire electric plug unit and used with a three-wire electric plug according to the present invention.

DETAILED DESCRIPTION OF THE PREFERRED EMBODIMENT

Figure 3:
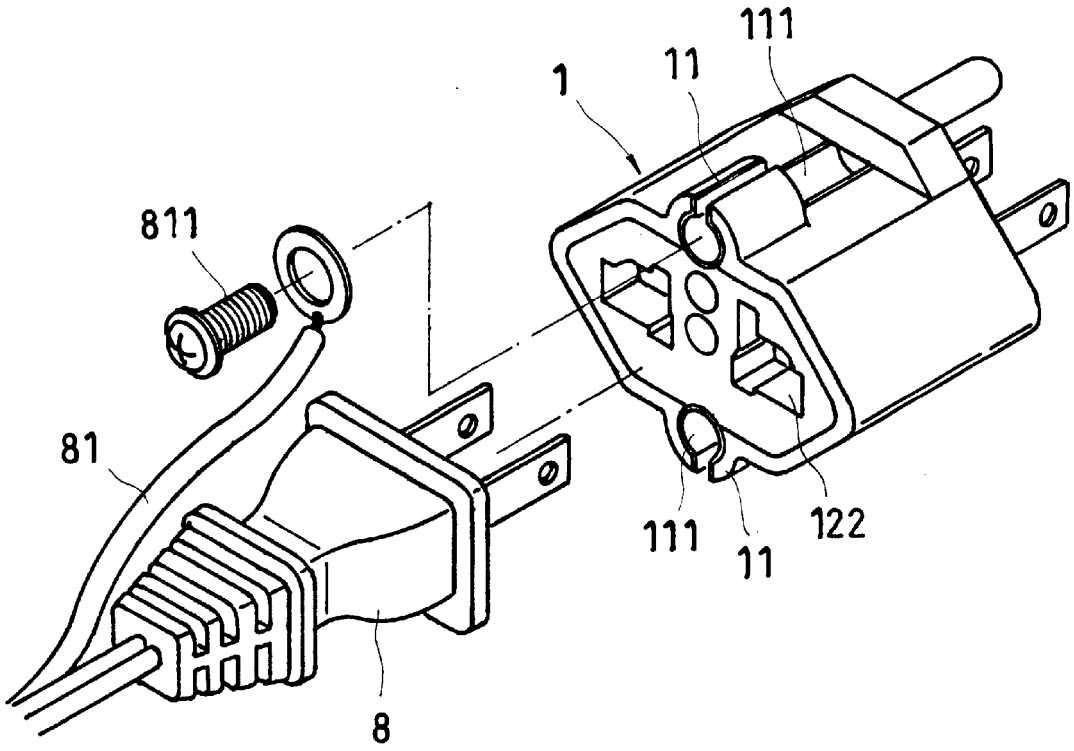
FIG. 3 shows an application example of the combination electric connector shown in FIG. 1.
Figure 5:
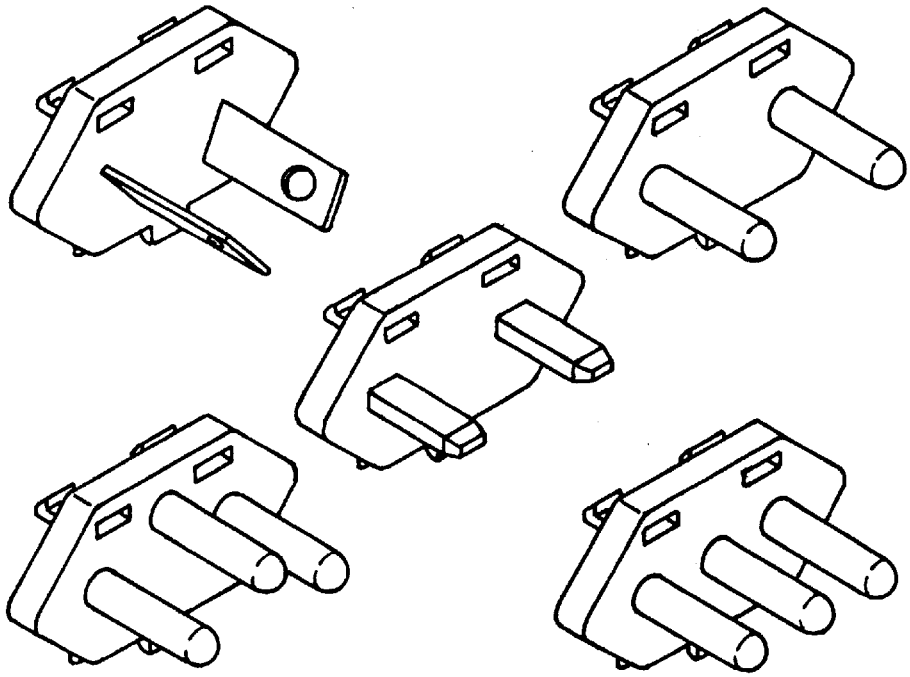
FIG. 5 shows different alternate forms of the plug unit for the combination electric connector according to the present invention.
Figure 4:
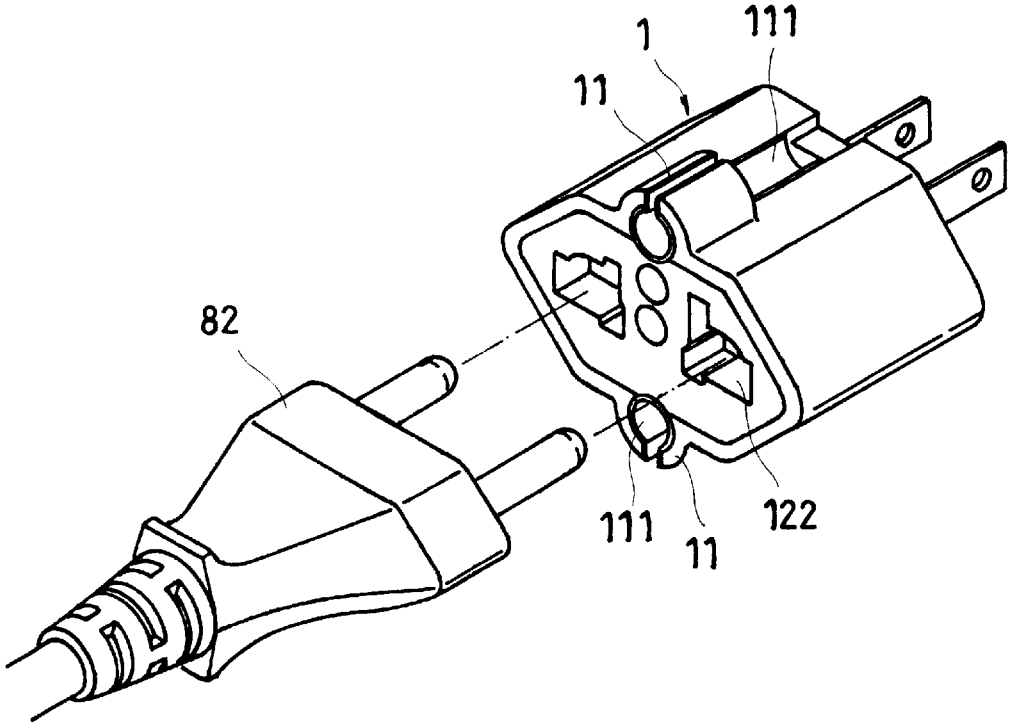
FIG. 4 is an elevational view of the combination electric connector shown in FIG. 2.
Figures 1, 4:
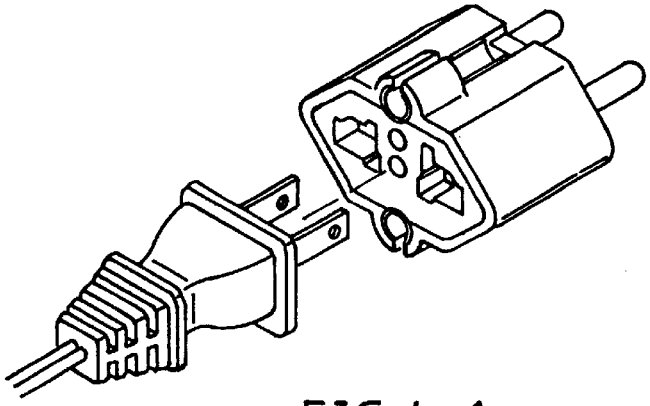
Figures 2, 4:
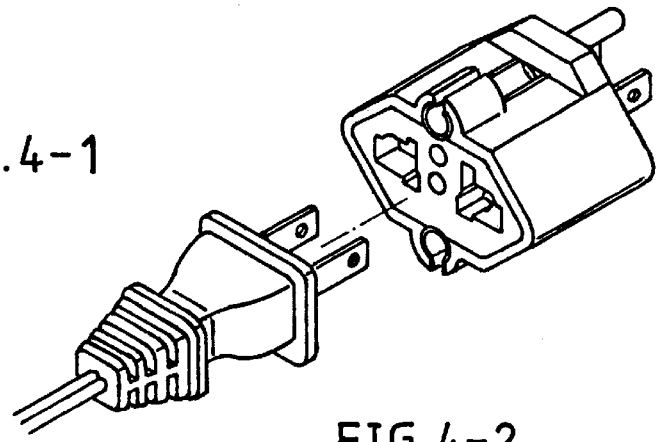
Figures 3, 4:
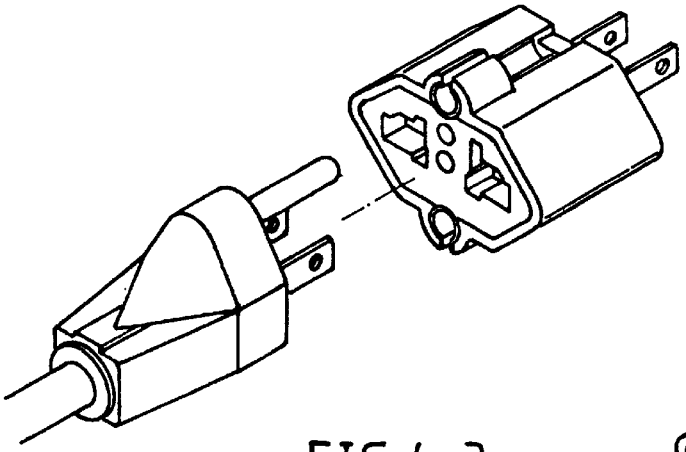
Figure 4:
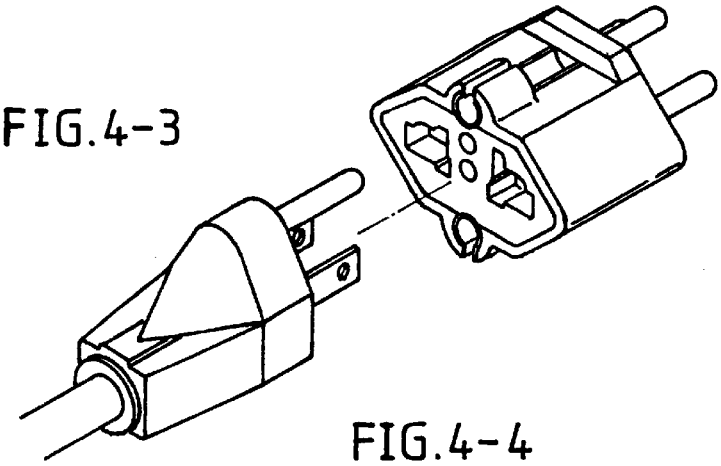

Referring to FIGS. from 1 through 5, a combination electric connector in accordance with one embodiment of the present invention is shown comprised of a socket unit 1, and a plug unit 2. The socket unit 1 comprises a set of plug blade receiving holes 122 extended through the front side thereof, two grounding prong receiving portions 11 disposed at two opposite lateral sides thereof, a substantially U-shaped grounding metal plate 111 installed in the grounding prong receiving portions 11 and extended over the rear side thereof, two metal contact plates 121 respectively mounted in the plug blade receiving holes 122 and extended out of the rear side The plug unit 2 comprises a plurality of hooks 22 and coupling flanges 23 respectively fastened to the rear side of the socket unit 1, and a set of metal rod members 21 for connection to an electric outlet. The metal rod members 21 may be variously embodied to fit different specifications. FIG. 5 shows different forms of the plug unit 2. When assembled, the metal rod members 21 are respectively disposed in contact with the metal contact plates 121 and grounding metal plate 111. By means of the plug blade receiving holes 122 and the grounding prong receiving portions 11, the socket unit 1 is practical to receive any of a variety of electric plugs 8, 82. FIGS. 3 and 4 and FIGS. from 4-1 through 4-4 show the combination electric connector uses with different electric plugs. FIG. 3 shows the combination electric connector uses with an electric plug 8 having a grounding wire 81. After insertion of the electric plug 8 into the plug blade receiving holes 122, the grounding wire 81 is fastened to one grounding prong receiving portion 11 by a tie screw 811, and secured to the grounding metal plate 111.

Figure 6:
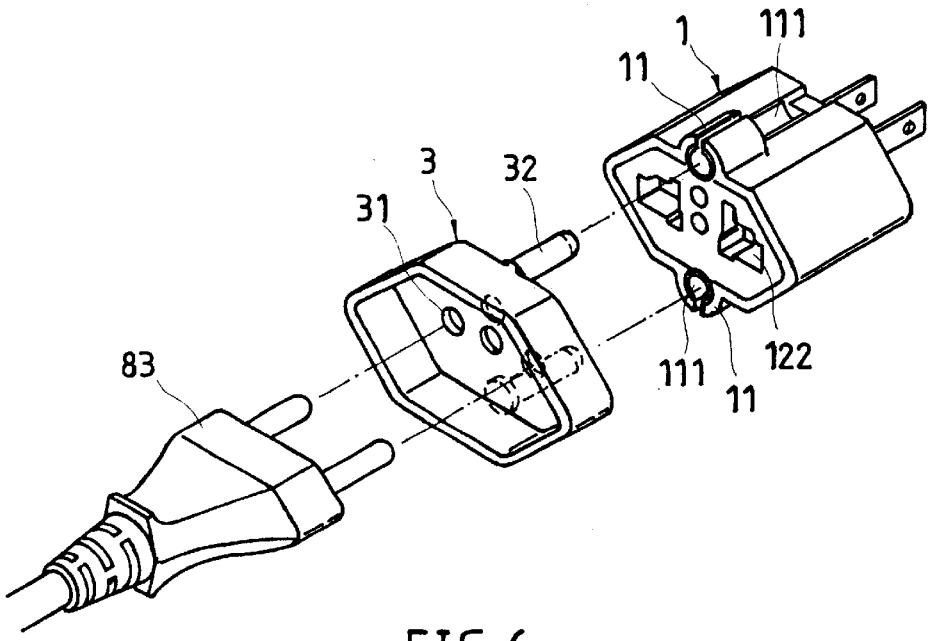
FIG. 6 shows the combination electric plug used with an electric plug adapter according to the present invention.
Figure 7:
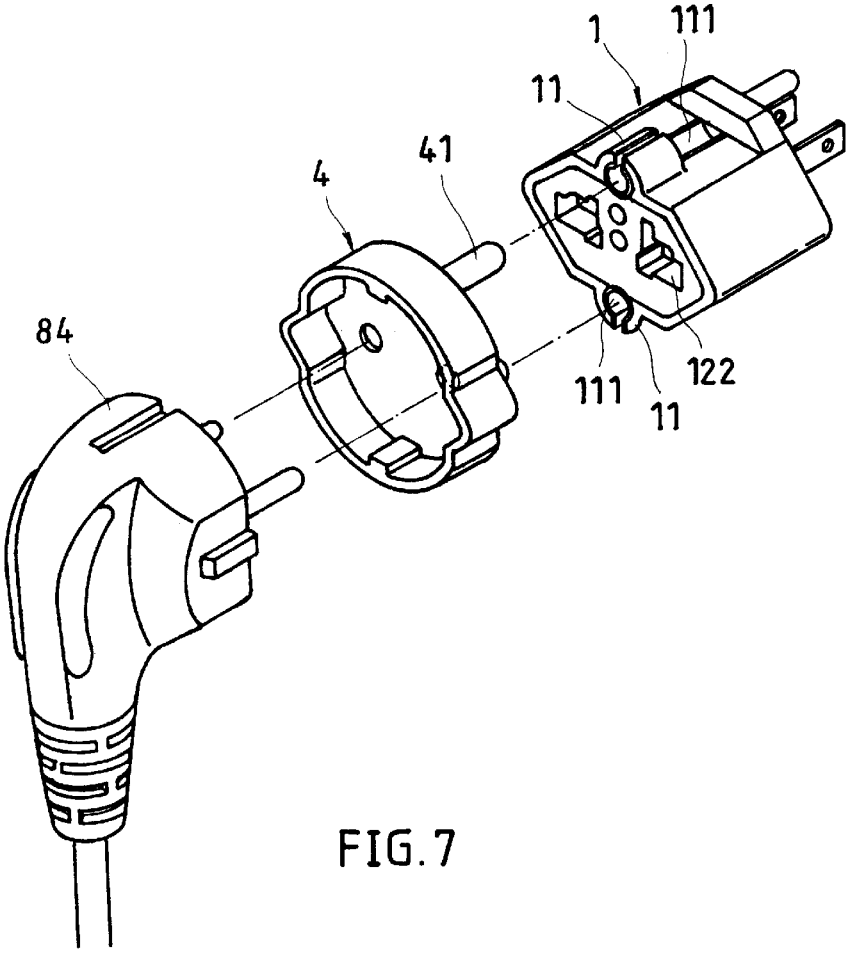
FIG. 7 shows the combination electric plug used with another structure of electric plug adapter according to the present invention.

Referring to FIGS. 6 and 7, an adapter 3 or 4 may be installed in the socket unit 1 to receive any of a variety of electric plugs 83, 84. The adapter 3 or 4 comprises a grounding prong 32 or 41 fastened to one grounding prong receiving portion 11, and a set of plug blade receiving holes 31 for receiving the metal rod members (metal blades and grounding prong) of any of a variety of electric plugs 83, 84.

Figure 8:
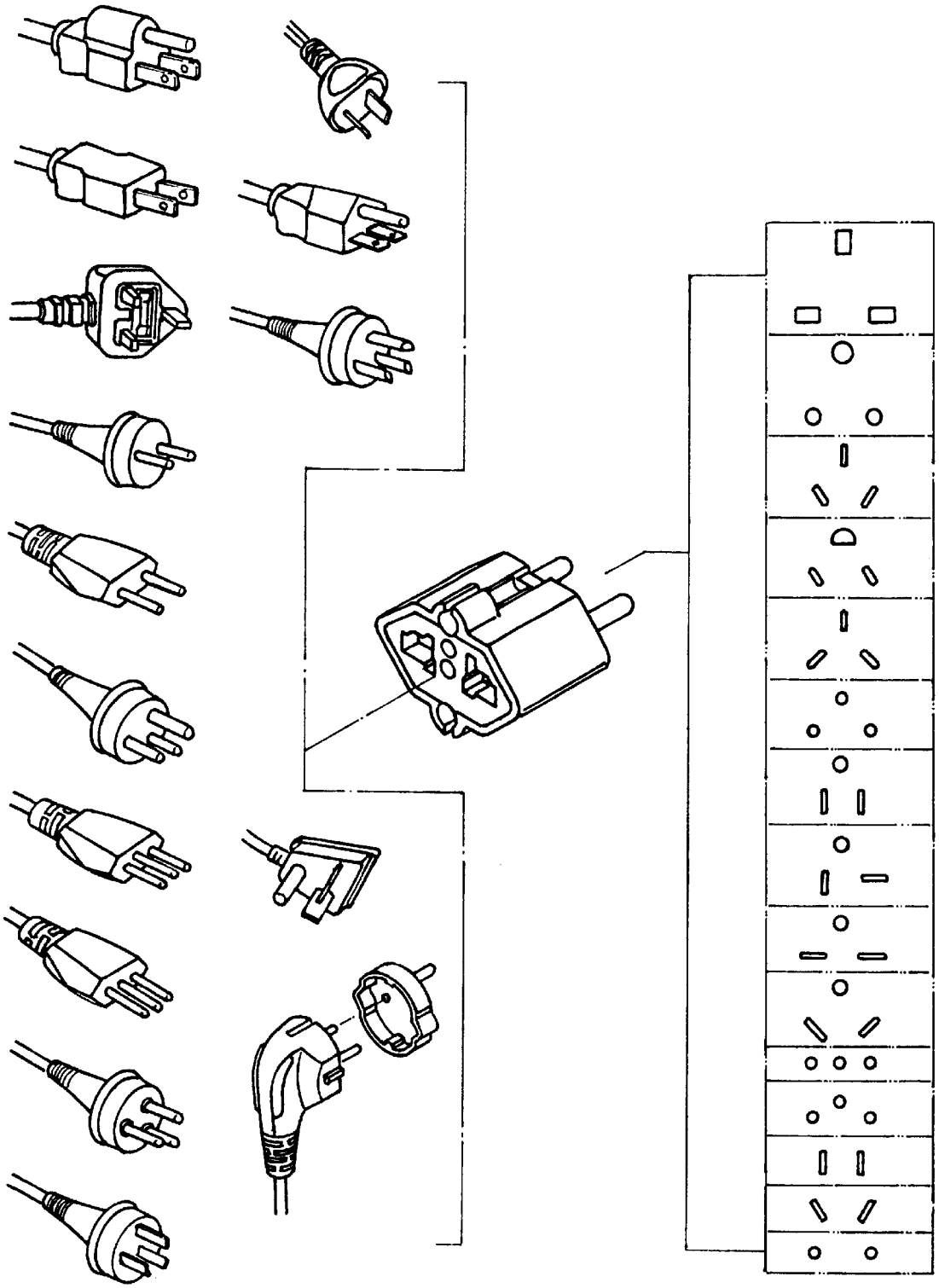
FIG. 8 explains the applicability of the combination electric connector according to the present invention.

Referring to FIG. 8, the combination electric connector fits different forms of electric sockets and different forms of electric plugs.

Figure 1:
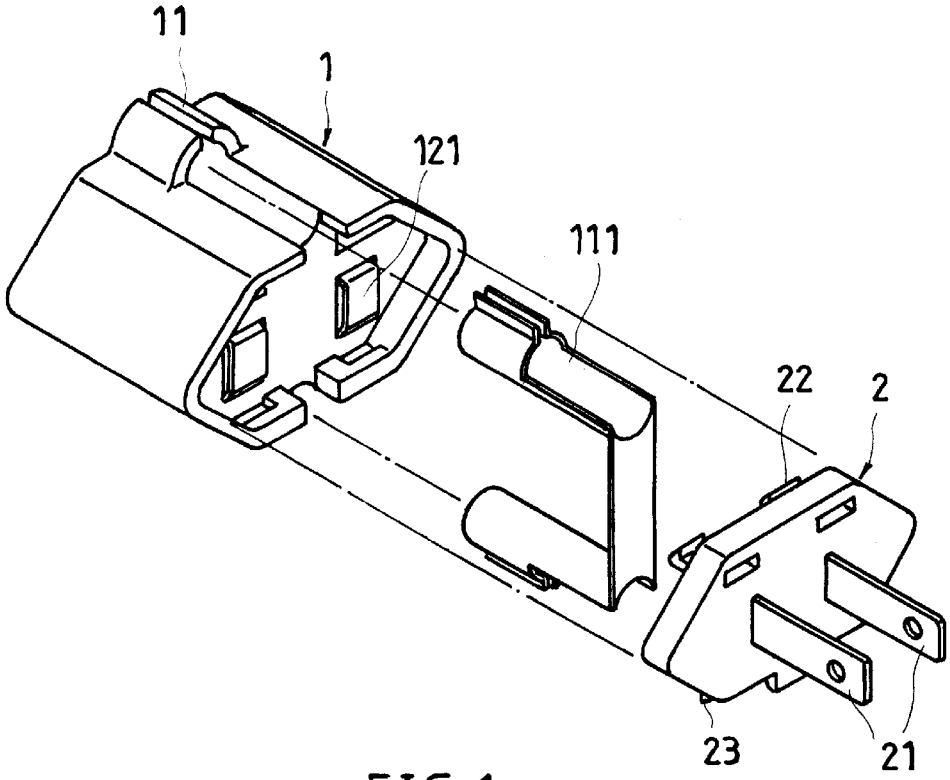
FIG. 1 is an exploded view of a combination electric connector according to one embodiment of the present invention.
Figure 2:
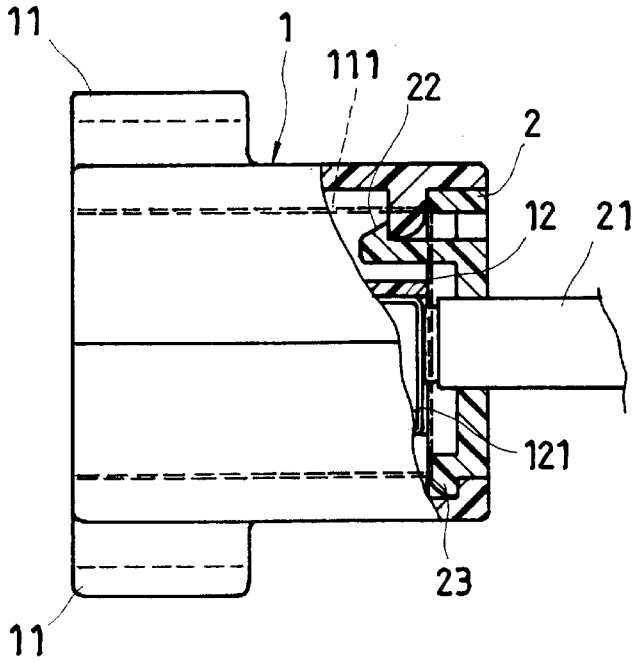
FIG. 2 is a sectional assembly view of the combination electric connector shown in FIG. 1.
Figure 9:
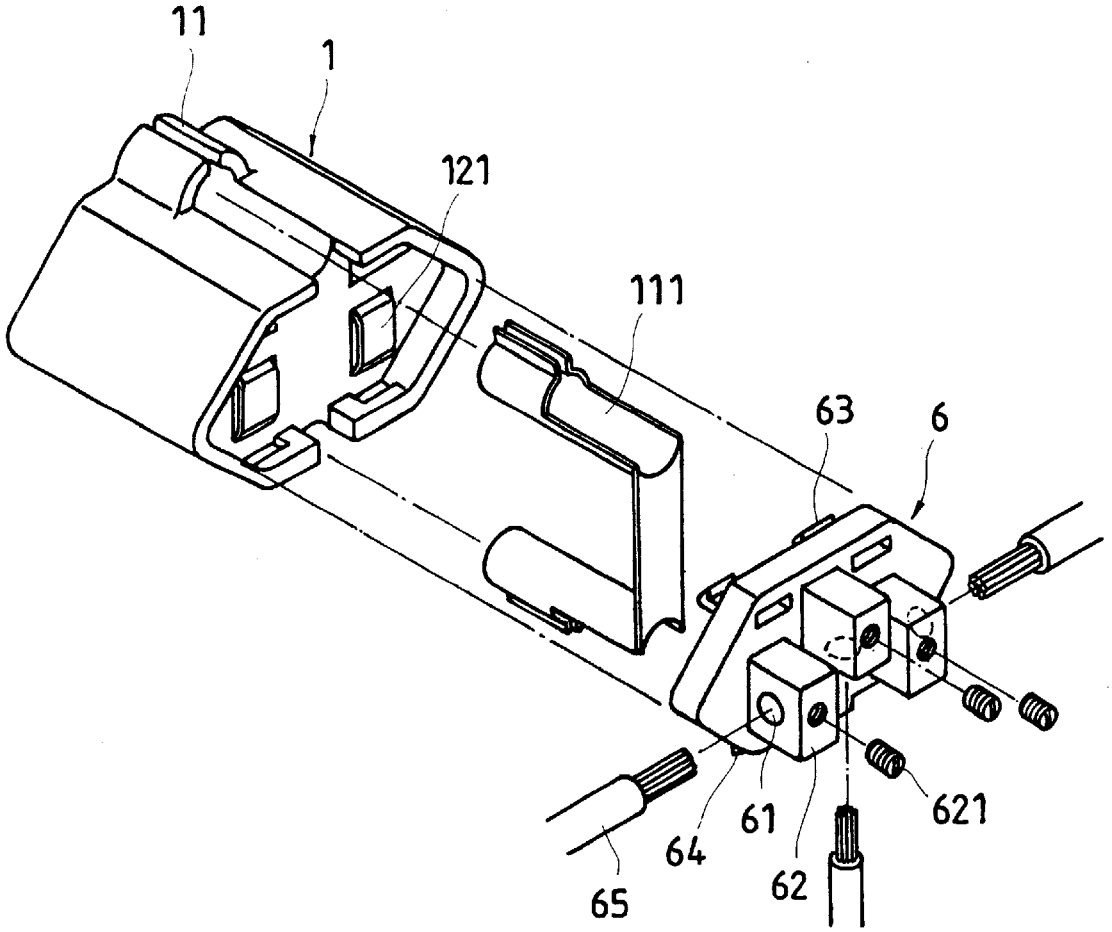
FIG. 9 is an exploded view of an alternate form of the combination electric connector according to the present invention.
Figure 10:
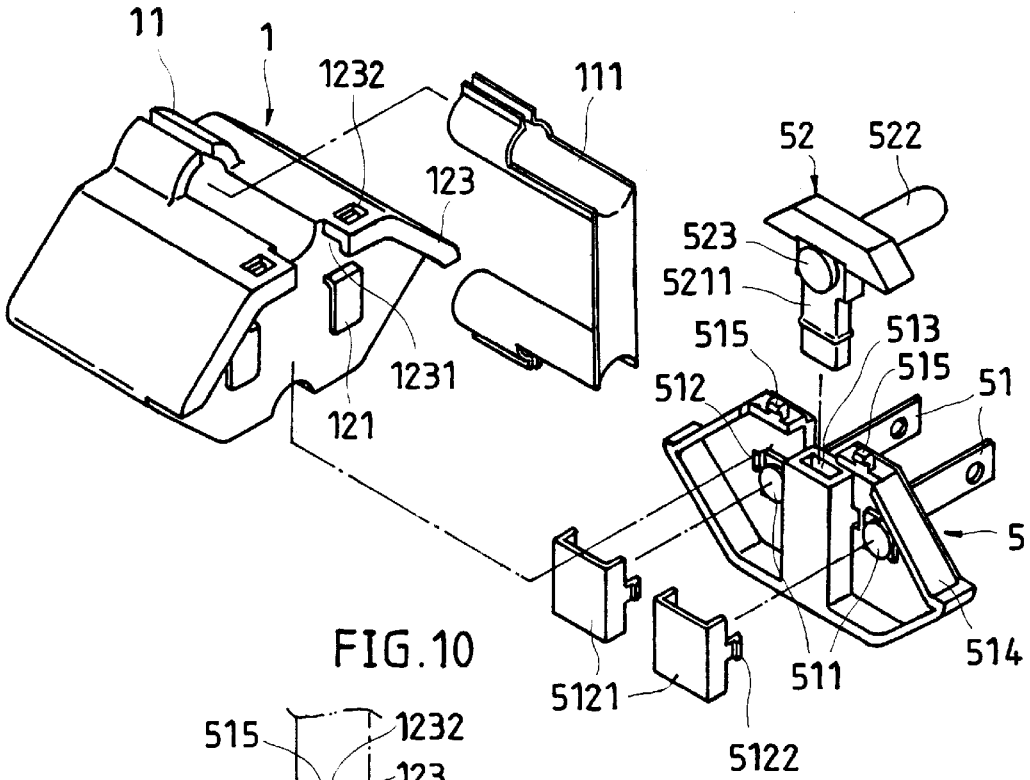
FIG. 10 is an exploded view of another alternate form of the combination electric connector according to the present invention.
Figure 12:
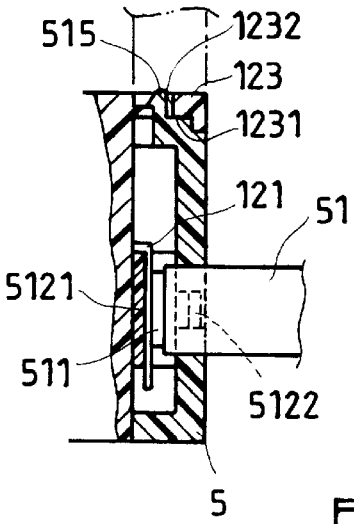
FIG. 12 is a sectional view of a part of the combination electric connector shown in FIG. 11.
Figure 11:
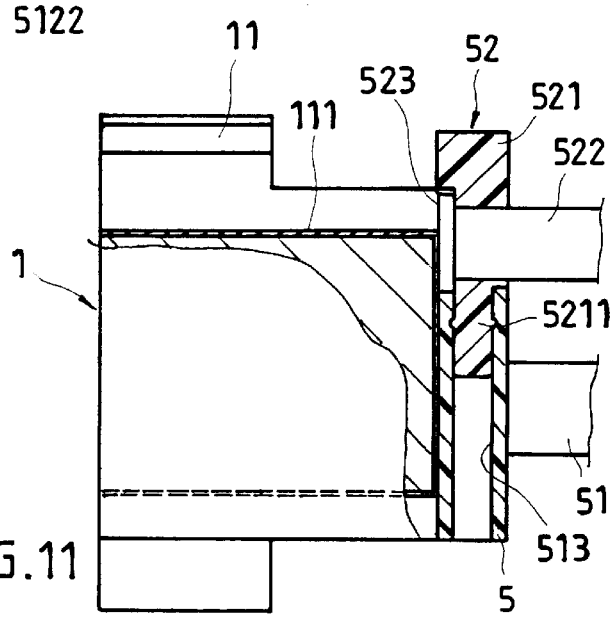
FIG. 11 is a sectional assembly view of the combination electric connector shown in FIG. 10

FIG. 9 shows an alternate form of the present invention. According to this alternate form, the combination electric connector comprises a socket unit 1, and a wire distribution plate 6 fastened to the socket unit 1. The socket unit 1 is same as the embodiment shown in FIG. 1. The wire distribution plate 6 comprises a plurality of hooks 63 and coupling flanges 64 for fastening to the rear side of the socket unit 1, and a plurality of wire holder blocks 62. The wire holder blocks 62 each comprise a wire hole 61 for receiving an electric wire 65, and a tightening up screw 621 for securing the loaded electric wire 65 in position.

Figure 13:
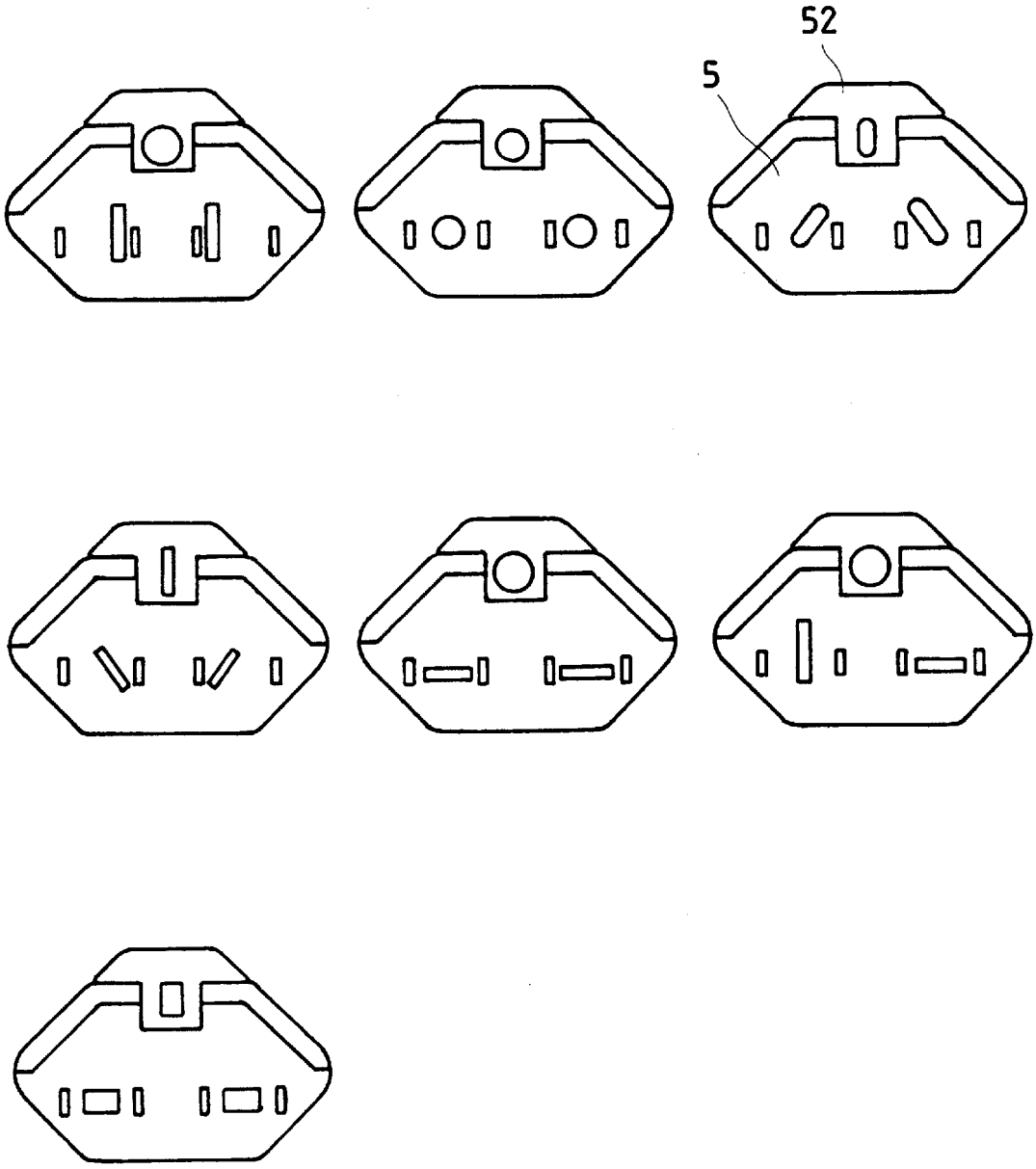
FIG. 13 shows different alternate forms of the plug unit for the combination electric connector shown in FIG. 10.
Figure 14:
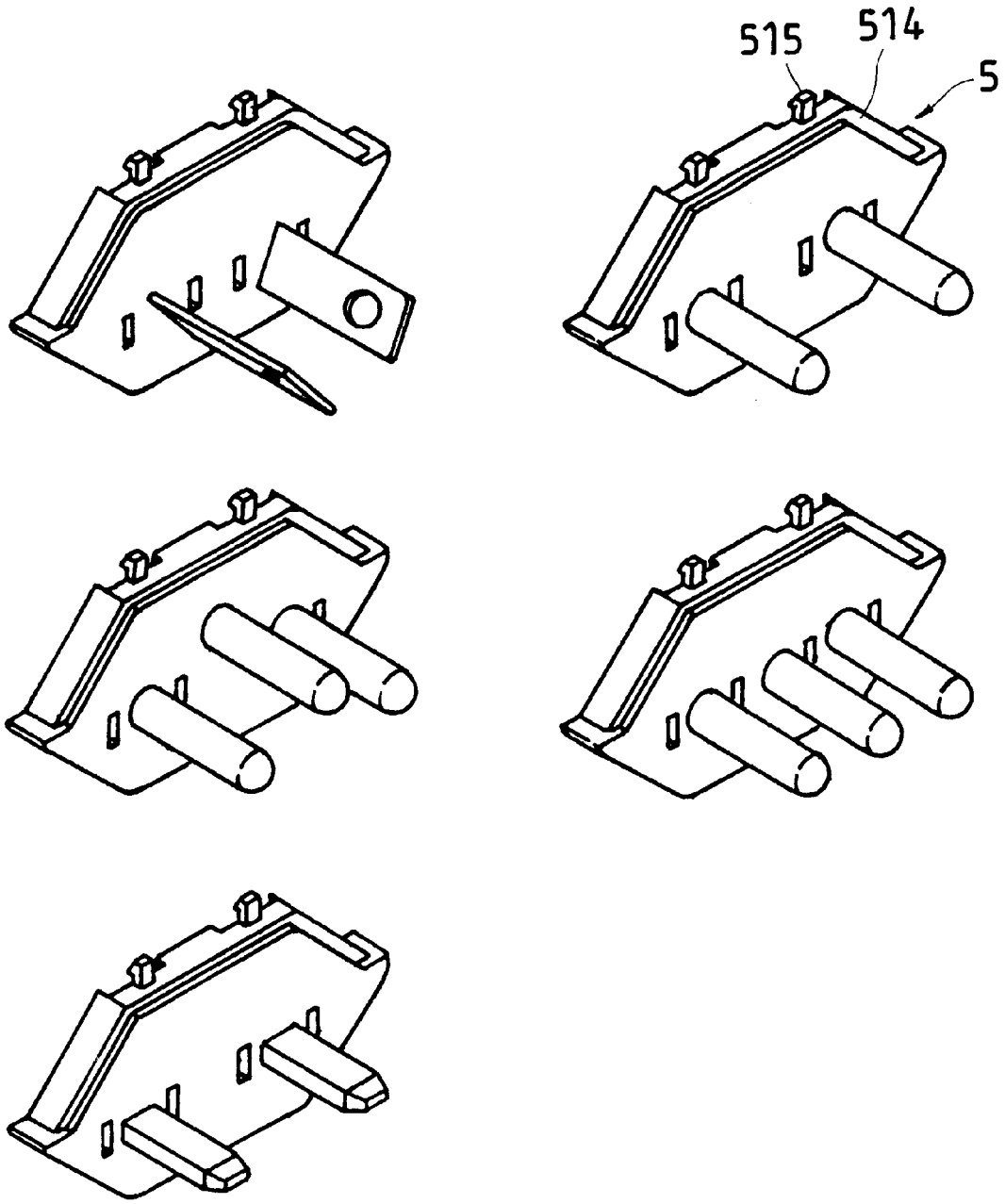
FIG. 14 shows difference alternate forms of the plug unit for the combination electric connector shown in FIG. 10.

FIGS. 10 through 13 show another alternate form of the present invention. According to this alternate form, the combination electric connector comprises a socket unit 1, and a plug unit 5 fastened to the socket unit 1. The socket unit 1 comprises two grounding prong receiving portions 11, two metal contact plates 121, a grounding metal plate 111, a rear locating flange 123 defining two coupling grooves 1231, and two hook holes 1232 through the rear locating flange 123. The plug unit 5 comprises two coupling flanges 514 respectively engaged into the coupling grooves 1231, two hooks 515 respectively hooked in the hook holes 1232 on the rear locating flange 123, two metal blades 51 each having a rear contact end 511 respectively disposed in contact with the metal contact plates 121, a transverse plug hole 513, and a detachable grounding prong assembly 52. The detachable grounding prong assembly 52 comprises a base 521 and a grounding prong 522 fastened to the base 521. The base 521 comprises a plug portion 5211 press-fitted into the transverse plughole 513. The grounding prong 522 has a rear contact end 523 disposed in contact with the grounding metal plate 111. The grounding prong 522 can be made having any of a variety of shapes to fit different specifications. Further, the plug unit 5 comprises two pairs of hook holes 512 respectively bilaterally disposed adjacent to the rear contact ends 511 of the metal blades 51, and two electrically insulative protective plates 5121 are used to block the rear contact ends 511 of the metal blades 51 after removal of the socket unit 1 from the plug unit 5. The electrically insulative protective plates 5121 each comprise two hooks 5122 respectively hooked in the hook holes 512. FIGS. 13 and 14 show different alternate forms of the plug unit 5. As illustrated, the grounding prong can be directly fixedly fastened to the plug unit 5.

Figure 15:
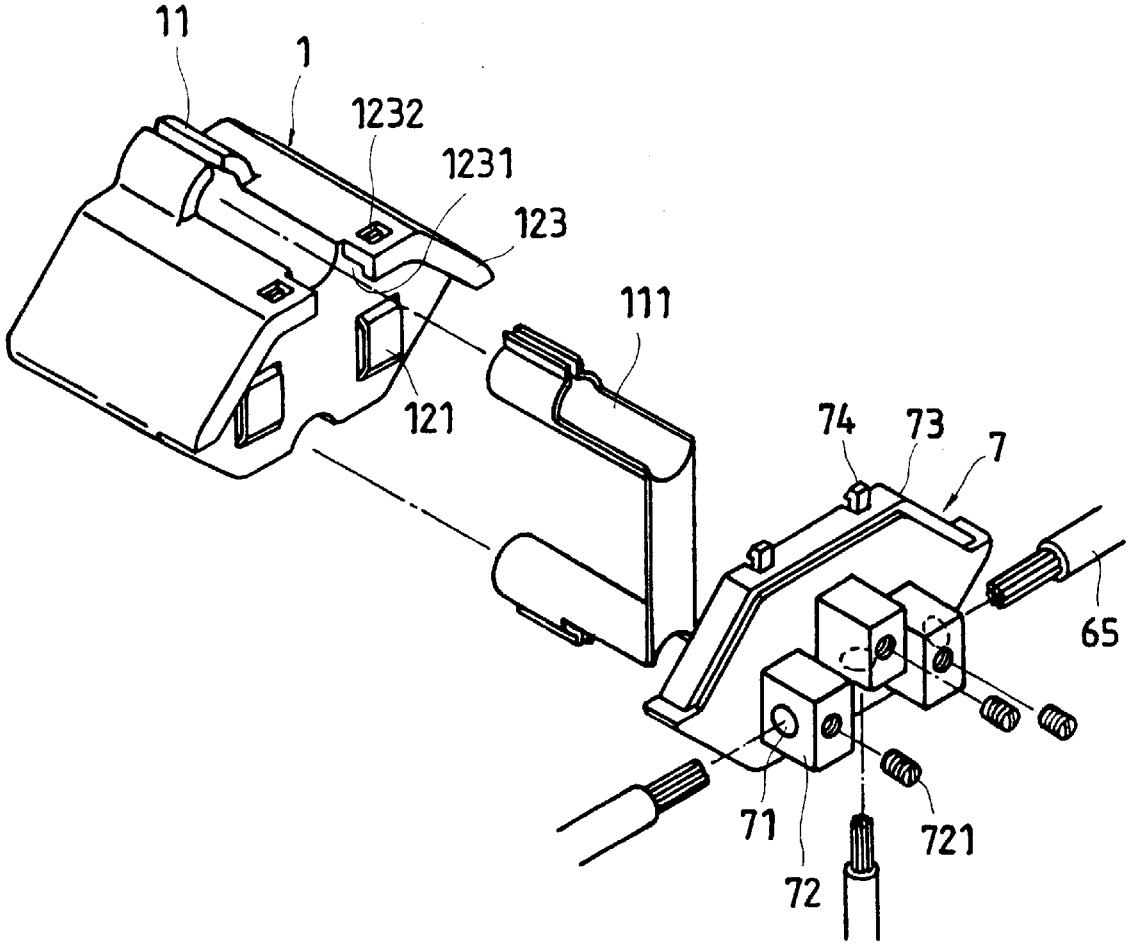
FIG. 15 is an exploded view of still another alternate form of the combination electric connector according to the present invention.
Figure 16:
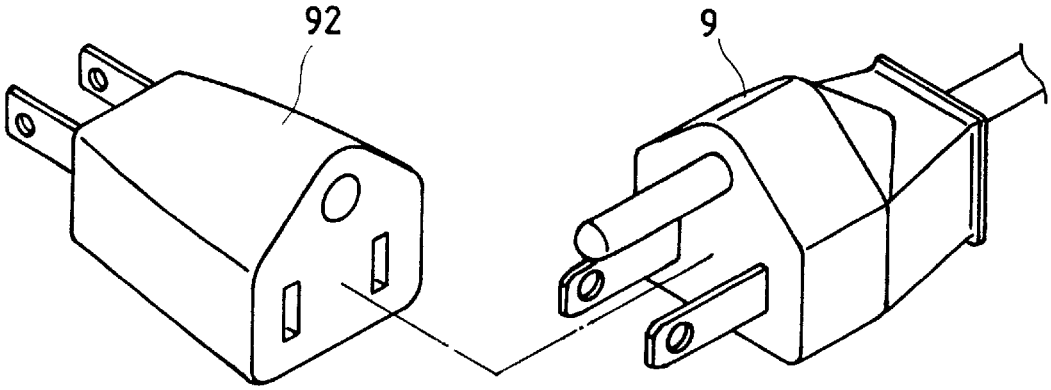
FIG.16 PRIOR ART
FIG. 16 shows an electric plug adapter used with a three-wire electric plug according to the prior art.

FIG. 15 shows still another alternate form of the combination electric connector according to the present invention. According to this alternate form, the combination electric connector is comprised of a socket unit 1, and a wire distribution plate 7 fastened to the socket unit 1. The socket unit 1 is same as the embodiment shown in FIG. 10. The wire distribution plate 7 comprises two hooks 74 respectively hooked in the hook holes 1232 on the rear locating flange 123 fo the socket unit 1, and a plurality of wire holder blocks 72. The wire holder blocks 72 each comprise a wire hole 71 for receiving an electric wire 65, and a tightening up screw 721 for securing the loaded electric wire 65 in position.

It is to be understood that the drawings are designed for purposes of illustration only, and are not intended for use as a definition of the limits and scope of the invention disclosed.

What the invention claimed is:

1. A combination electric connector comprising:

a socket unit for receiving an electric plug having metal blades, said socket unit having a front side, an opposing rear side and a plurality of lateral sides extending between perimeter portions of said front and rear sides, said socket unit comprising (a) a plurality of plug blade receiving holes extended through said front side of said socket unit for receiving the metal blades of the electric plug, (b) two grounding prong receiving portions respectively disposed at two opposing of said lateral sides of said socket unit for receiving a ground connection of the electric plug of a type selected from the group consisting of a grounding prong and a grounding wire, (c) a substantially U-shaped grounding metal plate installed in said grounding prong receiving portions and extended over said rear side of said socket unit, and (d) two metal contact plates respectively mounted in said plug blade receiving holes and extended out of said rear side of said socket unit; and a plug unit fastened to said rear side of said socket unit, said plug unit comprising (a) a plurality of hooks and coupling flanges respectively fastened to the rear side of said socket unit, and (b) a plurality of metal rod members for connection to an electric outlet, said metal rod members each having a rear contact end electrically coupled to a respective one of said metal contact plates.

2. The combination electric connector of claim 1 wherein said metal rod members of said plug unit include a grounding prong electrically coupled to said grounding metal plate of said socket unit.

3. The combination electric connector of claim 1 further comprising an adapter fastened to said front side of said socket unit for receiving the electric plug, said adapter comprising a grounding prong fastened to one of said grounding prong receiving portions of said socket unit, and a plurality of plug blade receiving holes for receiving the metal rod members of the electric plug.

4. The combination electric connector of claim 1 wherein said plug unit comprises a transverse plug hole, and a detachable grounding prong assembly, said detachable grounding prong assembly comprising a base having a plug portion press-fitted into said transverse plug hole, and a grounding prong, said grounding prong having a rear contact end disposed in contact with the grounding metal plate of said socket unit.

5. The combination electric connector of claim 1 further comprising two electrically insulative protective plates for fastening to said plug unit to block the rear contact ends of said metal rod members after removal of said socket unit from said plug unit, said electrically insulative protective plates each having a plurality of hooks respectively fastened to respective hook holes on said plug unit.

6. A combination electric connector comprising:

a socket unit for receiving an electric plug having metal blades, said socket unit having a front side, an opposing rear side and a plurality of lateral sides extending between perimeter portions of said front and rear sides, said socket unit comprising (a) a plurality of plug blade receiving holes extended through said front side of said socket unit for receiving the metal blades of the electric plug, (b) two grounding prong receiving portions respectively disposed at two opposing of said lateral sides of said socket unit for receiving a ground connection of the electric plug of a type selected from the group consisting of a grounding prong and a grounding wire, (c) a substantially U-shaped grounding metal plate installed in said grounding prong receiving portions and extended over said rear side of said socket unit, and (d) two metal contact plates respectively mounted in said plug blade receiving holes and extended out of said rear side of said socket unit; and a wire distribution plate fastened to said rear side of said socket unit, said wire distribution plate comprising a plurality of wire holder blocks, and a plurality of screws respectively installed in said wire holder blocks to hold corresponding electric wires in contact with said metal contact blades and said grounding metal plate of said socket.

7. The combination electric connector of claim 6 wherein said socket unit comprises a pair of rear locating flanges respectively defining two coupling grooves, each of said rear locating flanges having a hook hole formed therein; said wire distribution plate comprises two coupling flanges respectively engaged into said coupling grooves in said rear locating flanges of said socket unit, and two hooks respectively hooked in said hook holes of said rear locating flanges of said socket unit.

* * * * *